US009955765B2

(12) United States Patent
Schmitz et al.

(10) Patent No.: US 9,955,765 B2
(45) Date of Patent: May 1, 2018

(54) MANUALLY OPERATED PUMP WITH A FIRST ACTUATION ELEMENT

(71) Applicant: APTAR DORTMUND GMBH, Dortmund (DE)

(72) Inventors: Detlef Schmitz, Unna (DE); Swen Barenhoff, Boenen (DE)

(73) Assignee: APTAR DORTMUND GMBH, Dortmund (DE)

( * ) Notice: Subject to any disclaimer, the term of this patent is extended or adjusted under 35 U.S.C. 154(b) by 2 days.

(21) Appl. No.: 15/027,514

(22) PCT Filed: Sep. 9, 2014

(86) PCT No.: PCT/EP2014/002432

§ 371 (c)(1),
(2) Date: Apr. 6, 2016

(87) PCT Pub. No.: WO2015/055266

PCT Pub. Date: Apr. 23, 2015

(65) Prior Publication Data

US 2016/0242528 A1 Aug. 25, 2016

(30) Foreign Application Priority Data

Oct. 18, 2013 (DE) ..... 10 2013 017 304
Apr. 15, 2014 (DE) ..... 10 2014 005 471
Jun. 25, 2014 (DE) ..... 10 2014 009 155

(51) Int. Cl.
*B67D 7/58* (2010.01)
*A45D 34/00* (2006.01)
(Continued)

(52) U.S. Cl.
CPC ..... *A45D 34/00* (2013.01); *B05B 11/3014* (2013.01); *B05B 11/3057* (2013.01);
(Continued)

(58) Field of Classification Search
CPC ..... A45D 34/00; A45D 2200/054; B05B 11/3014; B05B 11/3057; B05B 11/3059;
(Continued)

(56) References Cited

U.S. PATENT DOCUMENTS 3,478,935 A * 11/1969 Brooks ..... B05B 11/3057 222/321.8
4,033,487 A * 7/1977 Micallef ..... B05B 11/3029 222/207
(Continued)

FOREIGN PATENT DOCUMENTS

DE 69100066 T2 11/1993
DE 69433014 T2 4/2004
(Continued)

OTHER PUBLICATIONS

"Pump" Merriam-Webster.com. Merriam-Webster, Nov. 2017.*
(Continued)

*Primary Examiner* — Benjamin R Shaw
(74) *Attorney, Agent, or Firm* — Jason H. Vick; Sheridan Ross, PC

(57) ABSTRACT

A manually operated pump and a method for pumping a preferably cosmetic liquid are proposed in which actuation is performed either by manual linear actuation or by swiveling actuation using a lever mechanism. The pump can be equipped with a locking device that blocks actuation of the pump in the locked state. The delivery head of the pump can be integrally formed with the swivel lever. Moreover, components of the pump can advantageously be provided with a flexible or elastic layer.

25 Claims, 14 Drawing Sheets

Figure 1:
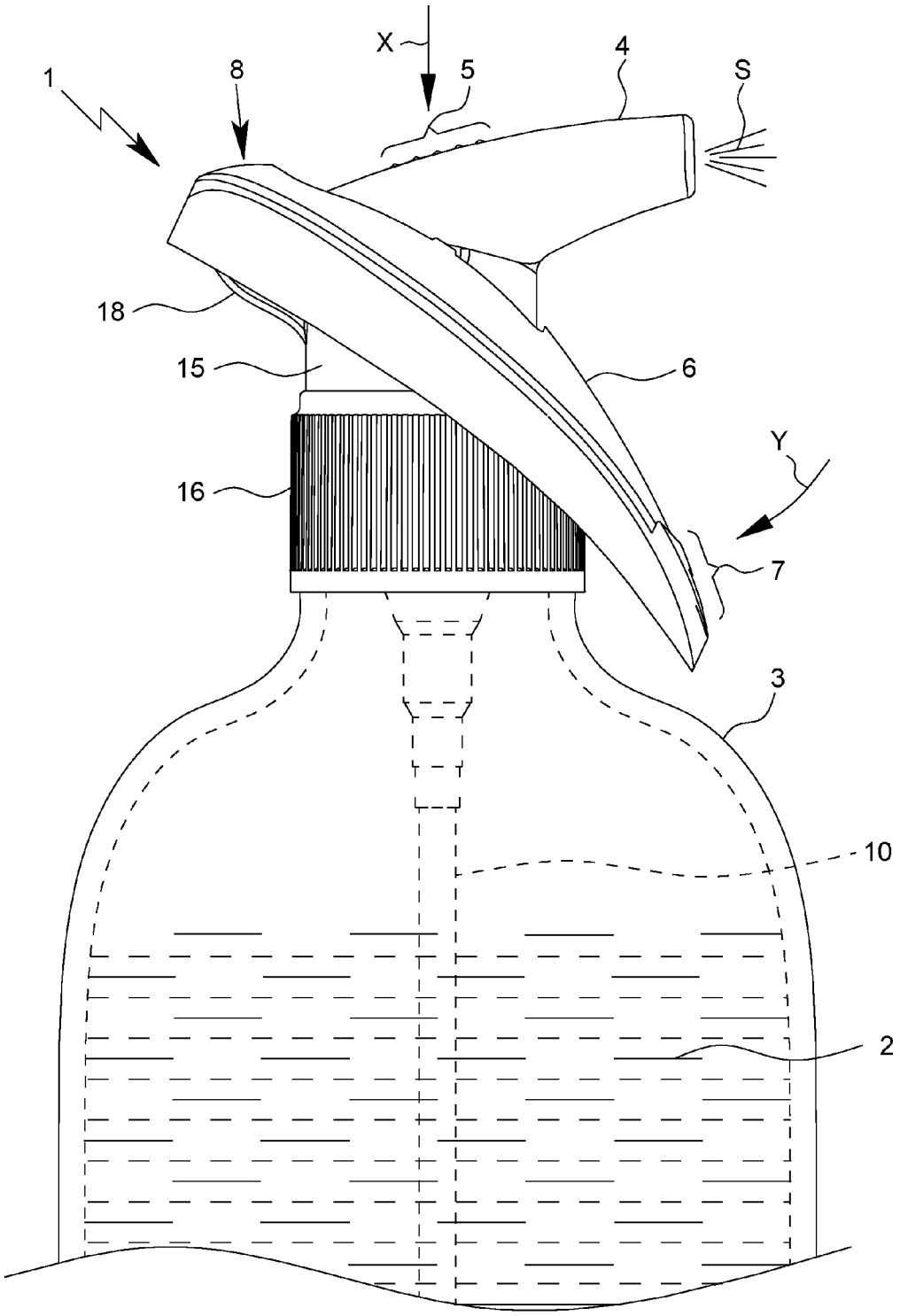

(51) Int. Cl.

| | |
|---|---|
| ***B05B 11/00*** | (2006.01) |
| ***F04B 9/14*** | (2006.01) |
| ***F04B 19/22*** | (2006.01) |
| ***F04B 23/02*** | (2006.01) |

(52) U.S. Cl.
CPC ..... *B05B 11/3059* (2013.01); *F04B 9/14* (2013.01); *F04B 19/22* (2013.01); *F04B 23/028* (2013.01); *A45D 2200/054* (2013.01); *B05B 11/3019* (2013.01); *B05B 11/3047* (2013.01)

(58) Field of Classification Search
CPC ..... B05B 11/3019; B05B 11/3047; B05B 12/002; B05B 11/00; F04B 9/14; F04B 19/22; F04B 23/028
USPC ..... 222/383.1
See application file for complete search history.

(56) References Cited

U.S. PATENT DOCUMENTS 4,077,549 A * 3/1978 Beard ..... B05B 11/3057 222/321.8
4,373,644 A * 2/1983 Bennett ..... B05B 11/3057 222/153.13
4,441,633 A * 4/1984 Bennett ..... B05B 11/3057 222/153.13
4,993,214 A * 2/1991 Corba ..... B05B 11/3011 222/321.8
5,152,425 A 10/1992 Baudin
5,839,616 A * 11/1998 Irwin ..... B05B 11/3057 222/321.8
6,851,625 B1 * 2/2005 Kuo ..... B05B 1/34 239/333
2005/0082311 A1 * 4/2005 Good ..... B05B 11/3059 222/1
2006/0113327 A1 * 6/2006 Walters ..... B05B 11/3014 222/153.11
2006/0138176 A1 * 6/2006 Lasserre ..... B05B 11/3057 222/321.8
2008/0251538 A1 * 10/2008 Carta ..... B05B 11/3059 222/153.13
2009/0127293 A1 * 5/2009 De Laforcade ..... B05B 11/3059 222/402.11
2011/0155764 A1 * 6/2011 Lee ..... B05B 11/3057 222/153.13
2011/0284592 A1 * 11/2011 Alluigi ..... B05B 11/3025 222/321.8

FOREIGN PATENT DOCUMENTS

| | | |
|---|---|---|
| WO | WO 95/08400 | 3/1995 |
| WO | WO 2007/149459 | 12/2007 |
| WO | WO 2011/159330 | 12/2011 |

OTHER PUBLICATIONS

International Search Report for corresponding International Application No. PCT/EP2014/002432, dated Mar. 3, 2015.
Written Opinion for corresponding International Application No. PCT/EP2014/002432, dated Mar. 3, 2015.

* cited by examiner

MANUALLY OPERATED PUMP WITH A FIRST ACTUATION ELEMENT

CROSS REFERENCE TO RELATED APPLICATIONS

This application is a national stage application under 35 U.S.C. 371 of PCT Application No. PCT/EP2014/002432 having an international filing date of 9 Sep. 2014 which designated the United States, which PCT application claimed the benefit of German Application No. 10 2013 017 304.3 filed 18 Oct. 2013, German Application No. 10 2014 005 471.3 filed 15 Apr. 2014, and German Application No. 10 2014 009 155.4 filed 25 Jun. 2014, each of which are incorporated herein by reference in their entirety.

The invention relates to a manually operated pump according to the claims as appended hereto as well as a method for pumping a liquid according to the claims as appended hereto.

In the following, a manually operated pump is to be understood particularly as a pump for the dispensing of a liquid, preferably by spraying. Particularly, the term "manually operated pump" also includes dosing pumps, trigger pumps or lever pumps.

The term "liquid" is particularly to be understood as also including heterogeneous fluids, such as suspensions, fluids with gases or solid phases dispersed therein, as well as suspensions, emulsions, foams or the like.

The liquid can be dispensed particularly as a stream or as an atomized spray.

The term "liquid container" is to be understood as referring particularly to bottles, preferably those made of plastic, or similar liquid containers. In particular, these are liquid containers that are easy to handle, that is, that are dimensioned such that they can be held in one's hand or hands when using the pump.

Manually operated pumps are known from the prior art that have a first actuation element with a first actuation area and are embodied such that the liquid can be pumped by a force effect on the first actuation area in a first direction of actuation. An actuation area is to be understood here particularly as an area which, by virtue of its shape, its arrangement on the pump, its surface structure and/or its material, is designed to be grasped particularly with bare hands or with hands protected by gloves.

An "actuation element" is to be understood particularly as a component of a pump. This is particularly a component which, in the operating position of the pump, which can result, for example, from the structure of the unit of pump and liquid container, is located in the upper area of the pump and/or constitutes an element that can be manually actuated for the purpose of pumping.

A "direction of actuation" is to be understood as a direction in which a force effect must act on the actuation area in order to bring about the pumping of the liquid. The direction of actuation can have a tolerance range with respect to its orientation. That is, the force effect preferably need not occur in an exact direction with respect to the actuation area, but rather it is sufficient for the force effect to act on the first actuation area in the direction of a certain solid angle range relative to the pump.

It is the object of the present invention to provide an improved pump wherein the pump is more variable and more reliably manageable and/or protected against soiling and/or damage and/or has a simple, cost-effective and/or stable construction.

The above object is achieved by a manually operated pump according to the claims as appended hereto or by a method for pumping a liquid according to the claims as appended hereto. Advantageous developments are the subject matter of the subclaims.

One aspect of the present invention is that the pump has a second actuation element with a second actuation area that is separated, particularly spaced apart from, the first actuation area and is constructed such that the second actuation area can be moved manually in a second direction, i.e., a direction that is different from the first direction of actuation, i.e., in a different direction of actuation, in order to actuate the pump.

This makes it possible to actuate the pump selectively with a second movement, particularly swiveling movement, in a second direction that is different from the first movement, particularly linear movement, i.e., direction of actuation. Moreover, the separation of the second actuation area from the first actuation area makes it possible to have the force application for actuating the pump occur elsewhere on the pump.

Another aspect of the present invention that can also be implemented independently is that a pump element of the proposed pump can selectively be depressed manually and linearly or actuated using a lever mechanism. By virtue of the possibility of actuating the pump element using a lever mechanism, it is possible to use the pump even if the pump is gripped in a manner in which manual linear depression of the pump element, particularly using the hand that is gripping the pump, is not possible.

Preferably, the pump has a housing or outer casing, with it being possible to bring about the pumping of the liquid by moving the pump element relative to the outer casing. Particularly, the pump can thus be embodied in a haptically advantageous manner, whereby the simultaneous gripping of an actuation element and outer casing enables the easy and one-handed actuation of the pump element and operation of the pump.

Preferably, the first actuation element is associated with the pump element and/or embodied as a delivery head. This makes it possible for a force acting on the first actuation element to lead to a movement of the pump element, particularly relative to the outer casing. The first actuation element is advantageously arranged on the pump element, for example plugged onto or into it, or engaged in it, or the like. This direct arrangement of the first actuation element on the pump element or direct connection advantageously enables direct transmission of force into the pump element.

Preferably, the pump has a nozzle for spraying the liquid. Spraying is understood here particularly as the dispensing of liquid in the form of a stream or atomized spray. The stream can be delivered in a focused or fanned-out manner. It is also possible for the nozzle to be designed to produce a foam when spraying the liquid.

Preferably, the nozzle is associated with the first actuation element or held or formed by same. This results in advantages in terms of handling, particularly because, upon manual actuation of the pump over a first actuation area associated with the first actuation element, haptic feedback is created with respect to the alignment of the nozzle.

Preferably, the second actuation element is hinged or particularly swivel-mounted on the outer casing. Particularly, the second actuation element forms a lever or manually actuated swivel lever that acts upon the pump element or first actuation element or another component in order to form a lever mechanism for actuating the pump element or pump.

A preferably "loose" coupling of the second actuation element with the first actuation element or pump element makes it possible in particular for the two elements to move with a certain amount of play in relation to one another upon actuation of the pump. It is particularly possible in this manner for the conversion of a swiveling movement of the second actuation element into a linear or at least approximately linear movement of the first actuation element or pump element to be performed in an advantageous manner through such a coupling. Particularly if the coupling is embodied such that the contact or coupling point between the first actuation element and the second actuation element can shift in its position relative to the first or second actuation element during the actuation of the pump, that is, if a certain tolerance is enabled, a simple construction with few joints is possible.

Preferably, the second actuation element can be snap-fitted or otherwise engaged during the assembly of the pump. This enables easy and therefore cost-effective assembly of the pump.

The method according to the invention for pumping a liquid makes a provision that a first actuation element can selectively be depressed manually, thus moving a pump element linearly, or a second actuation element can be swiveled manually and the swiveling movement of the actuation element converted into a linear movement preferably of the same pump element. The pump can thus be universally actuated or operated and/or different pumping pressures and/or pumping volumes can easily be produced.

According to another aspect of the present invention that can also be implemented independently, the proposed pump preferably has a locking device for locking the actuation of the pump. The locking device is preferably arranged below a swivel lever of the pump. The locking device preferably works between a depressible pump element and a housing. The locking device preferably has a locking element that is particularly annular or sleeve-like or collar-like and/or can preferably be rotated about a central axis or direction of actuation of a pump element of the pump. This enables a very simple construction and/or intuitive operation.

According to another aspect of the present invention that can also be implemented independently, the first actuation element or the delivery head is integrally formed with the second actuation element or forms a structural unit. This enables very cost-effective manufacture and easy assembly of the pump.

Especially preferably, the first actuation element or the delivery head of the pump is connected via a preferably bar-, bridge- or bolt-like connecting part to the second actuation element or the swivel lever, with the connecting part particularly being flexible or elastic. In this way, a relative or swiveling movement between the first actuation element or delivery head and the second actuation element is possible.

According to another aspect of the present invention that can also be implemented independently, the second actuation element and/or a part that can be moved relative to the second actuation element, for example the first actuation element or the delivery head, the housing or outer casing or the liquid container, is provided with a flexible or elastic layer or coating. The layer or coating prevents, in particular, liquid and/or objects from getting into the pump or pump mechanics during actuation of the pump and damaging them or hindering the use or actuation of the pump. Moreover, the layer particularly minimizes the risk of a user injuring himself when actuating the pump, for example by pinching his hand in it. Independently of the safe handling of the pump, such a layer preferably provides a feel that is pleasant to and perceived as high-quality by the user. Furthermore, a smoother or more interruption-free surface can be produced in this way, and the cleaning of the pump can be simplified.

Preferably, the layer covers or fills—at least partially—an interspace, such as a gap, notch, space, or the like, between the second actuation element and the part that is movable relative to the second actuation element, particularly the first actuation element or delivery head, and/or a connecting part that connects the two parts that can be moved or swiveled relative to each other. In addition to the advantages already named above, this can advantageously reinforce or stabilize the pump and pumping mechanics, particularly the lever mechanism, or the construction of the pump.

The abovementioned aspects and other aspects and features that follow from the claims and the following description can be implemented independently of one another and in any combination.

Figure 2:
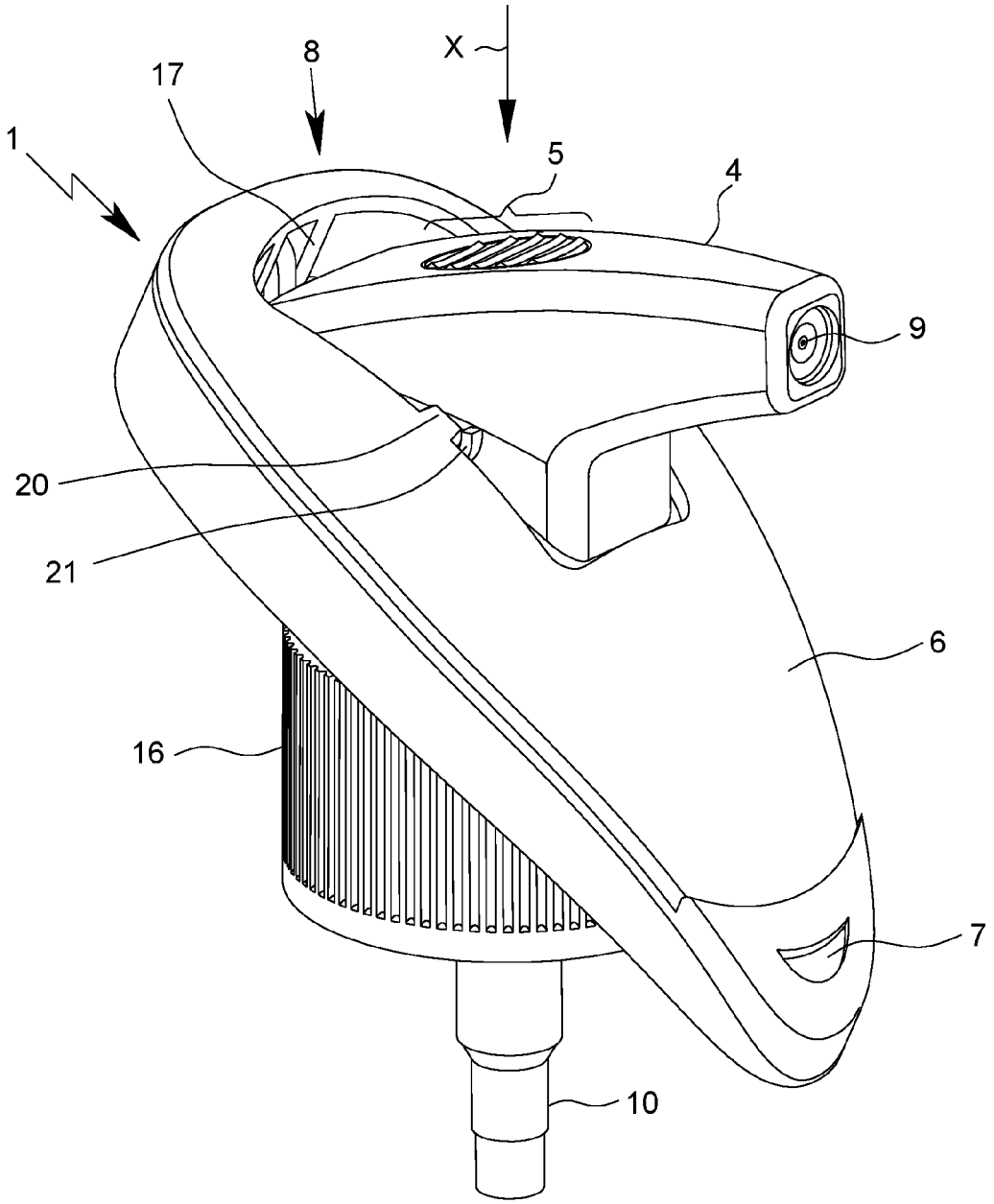
Figure 3:
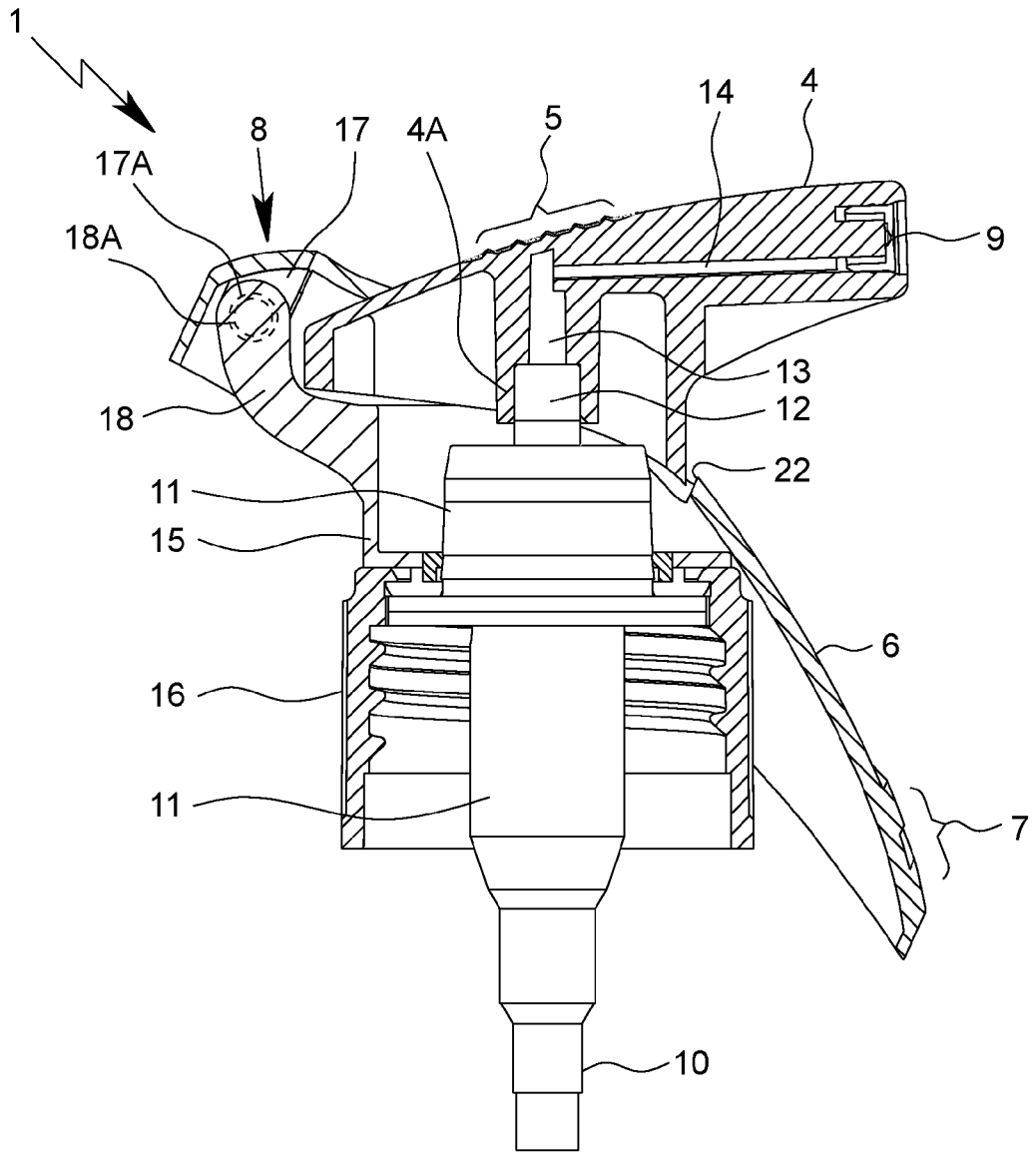
Figure 4:
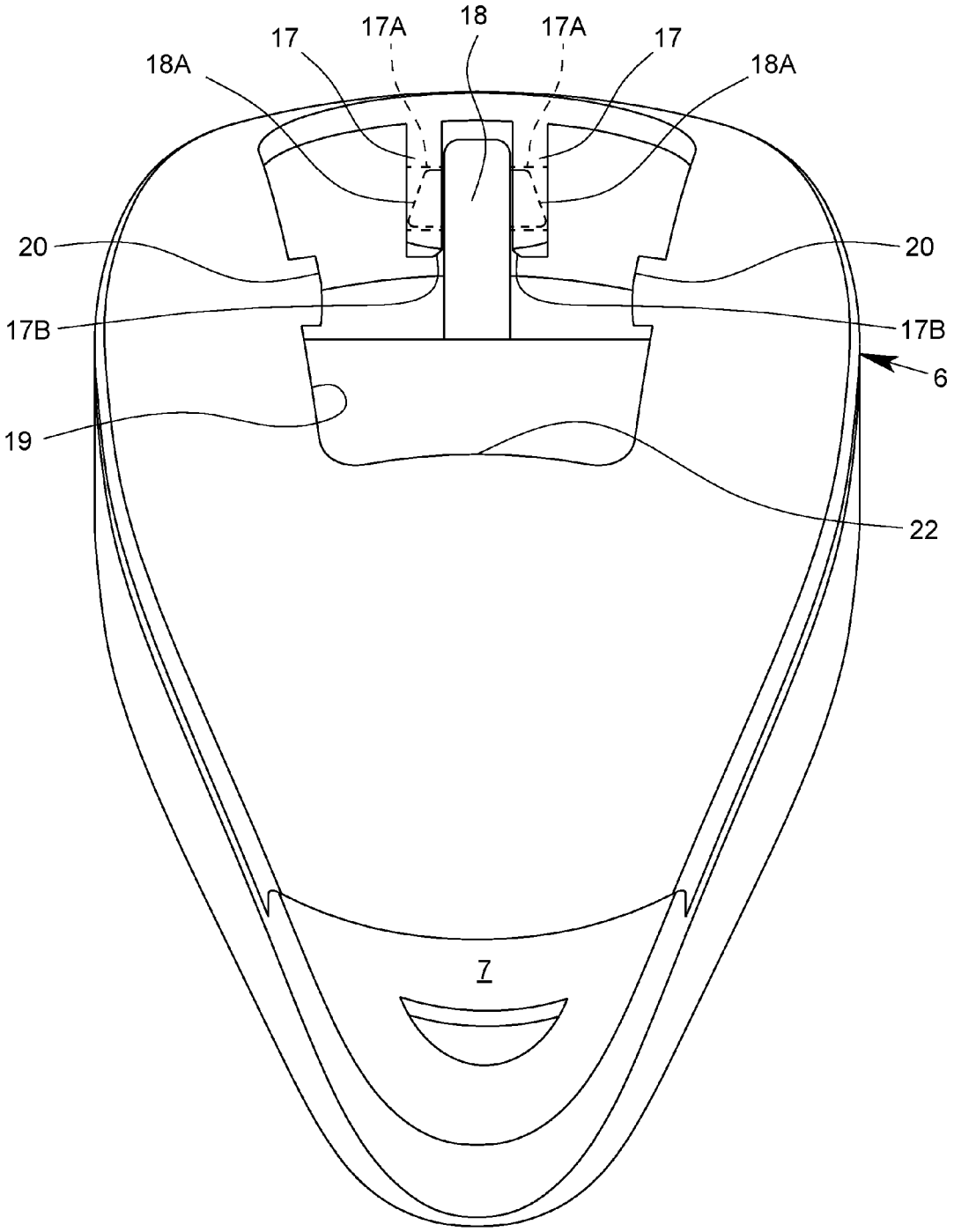
Figure 5:
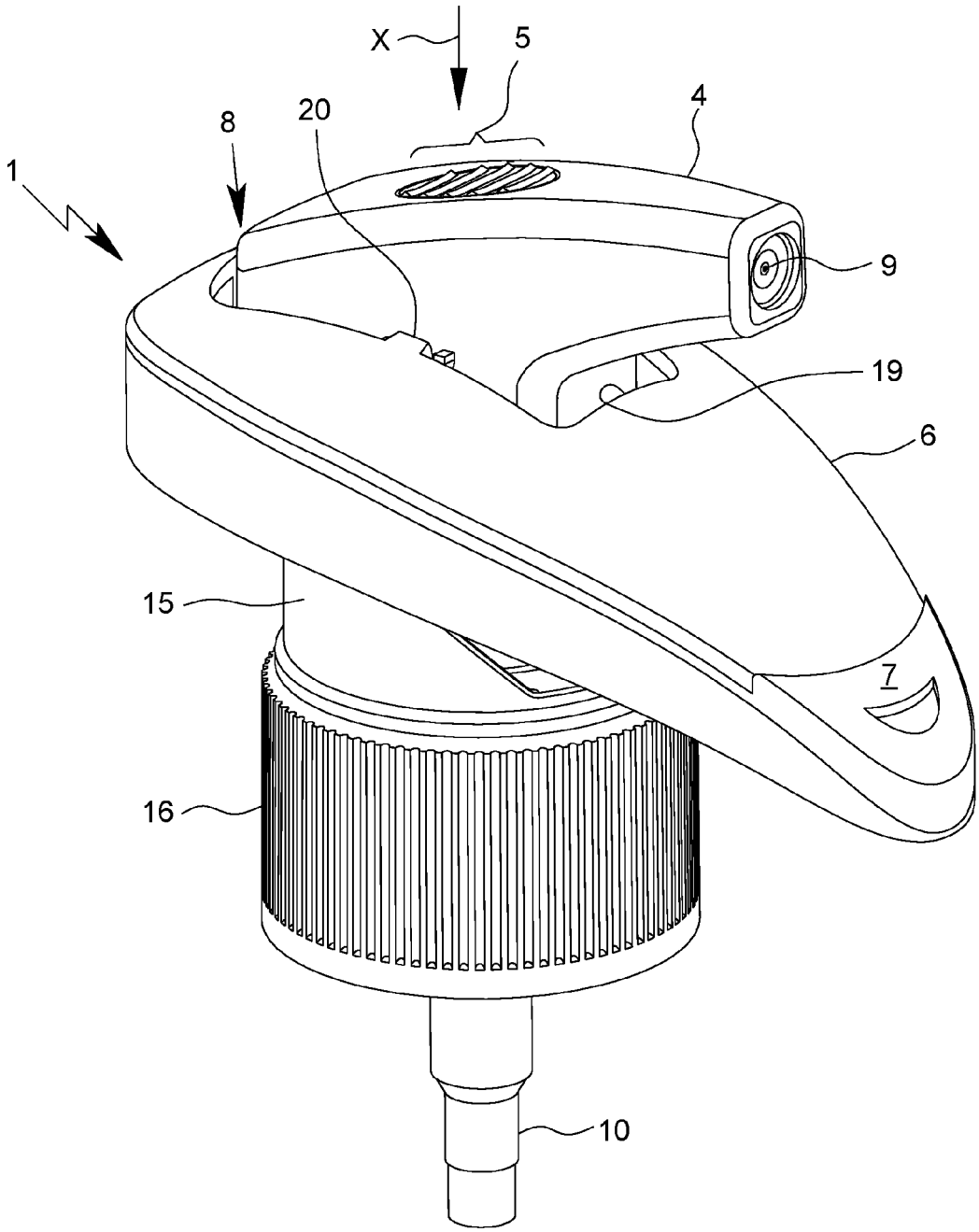
Figure 6:
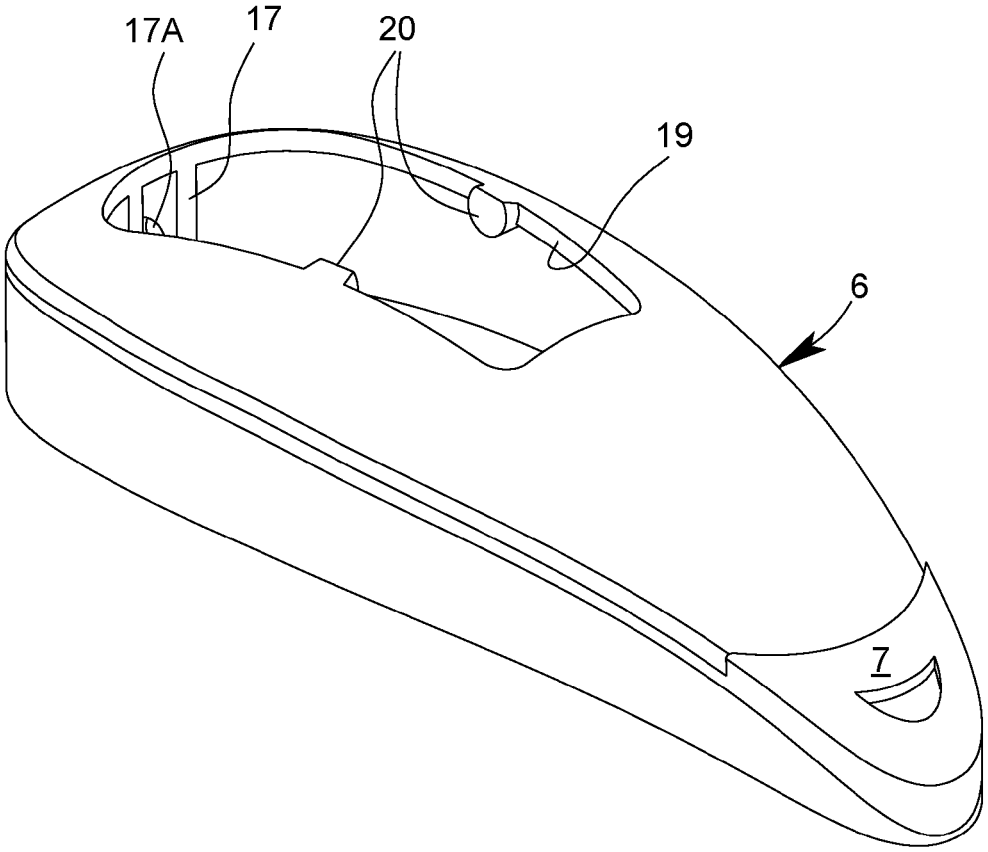
Figure 7:
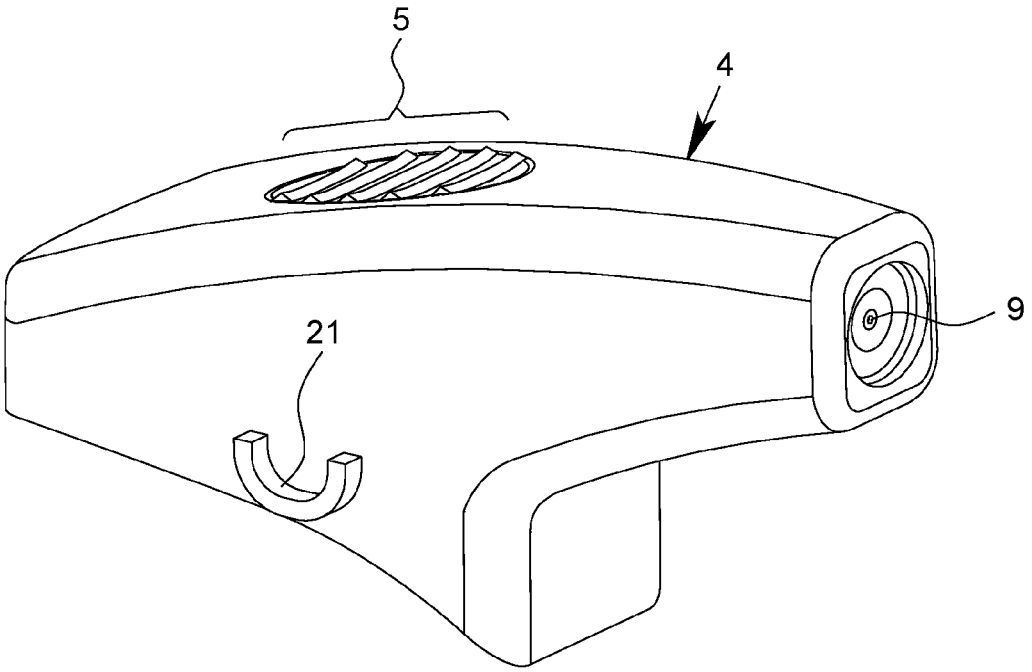
Figure 8:
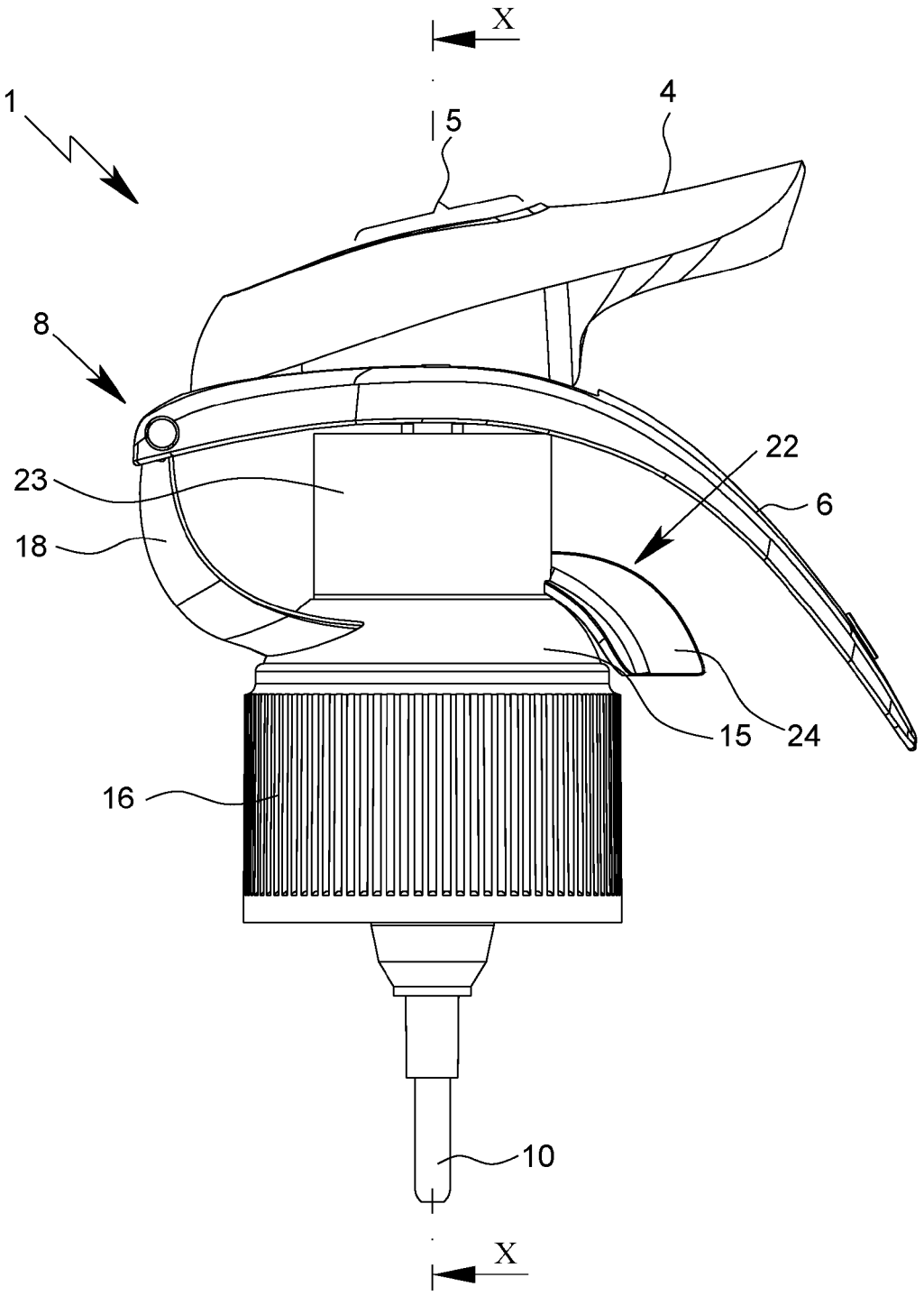
Figure 9:
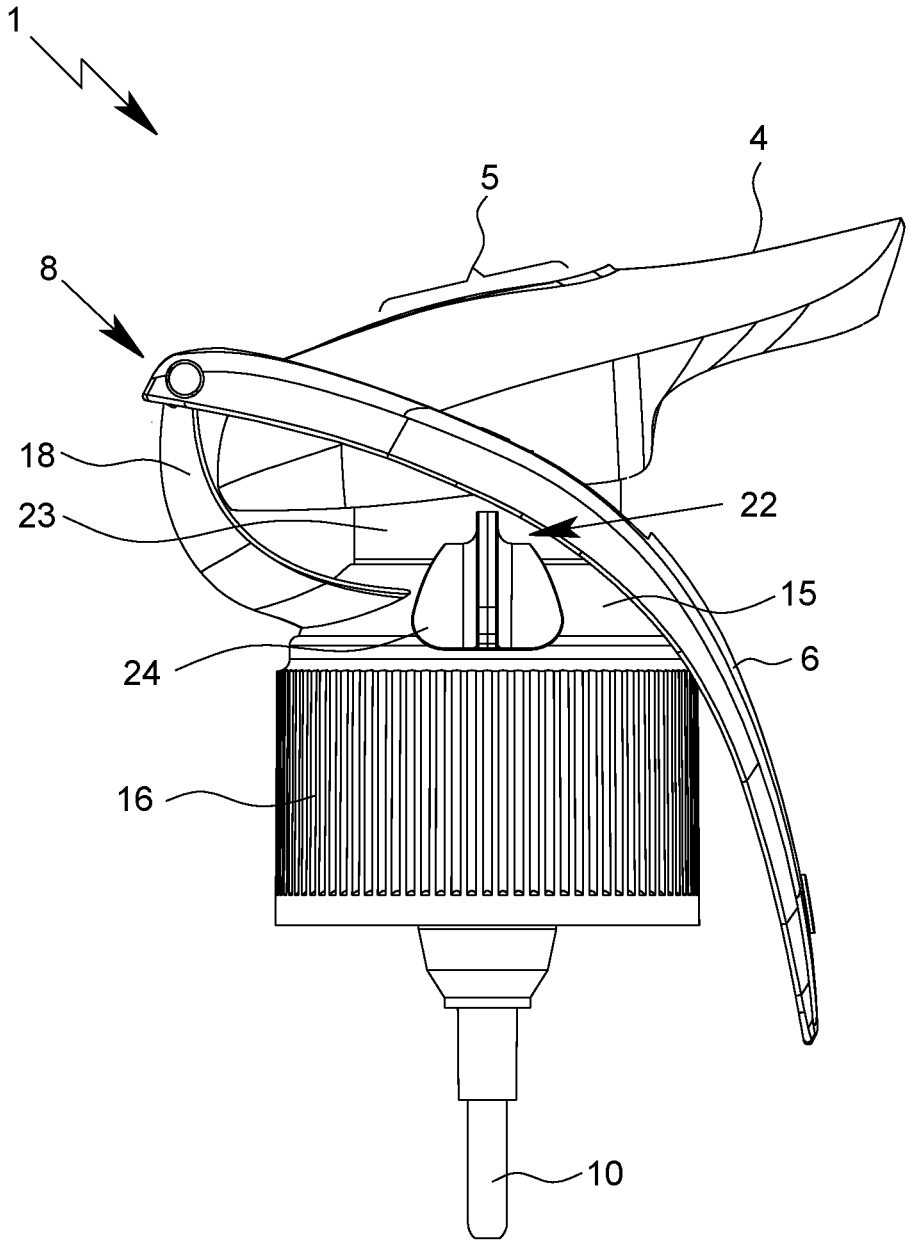
Figure 10:
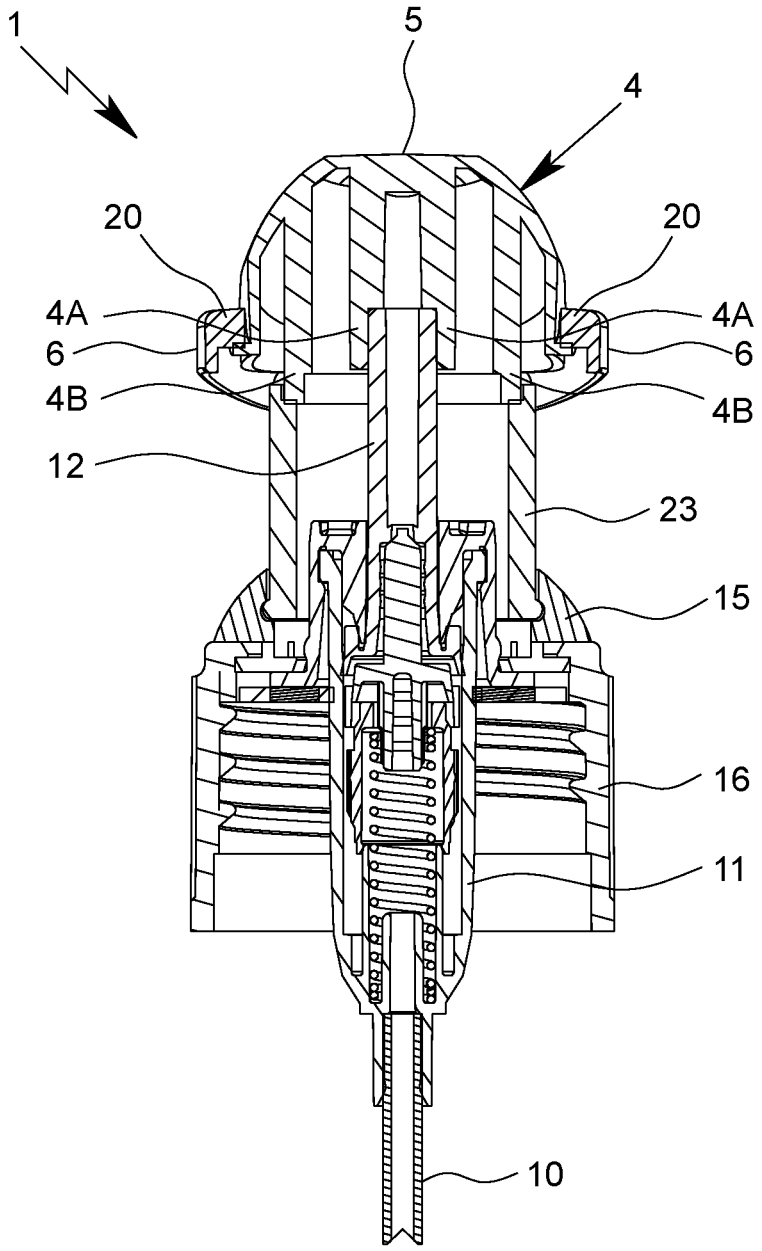
Figure 11:
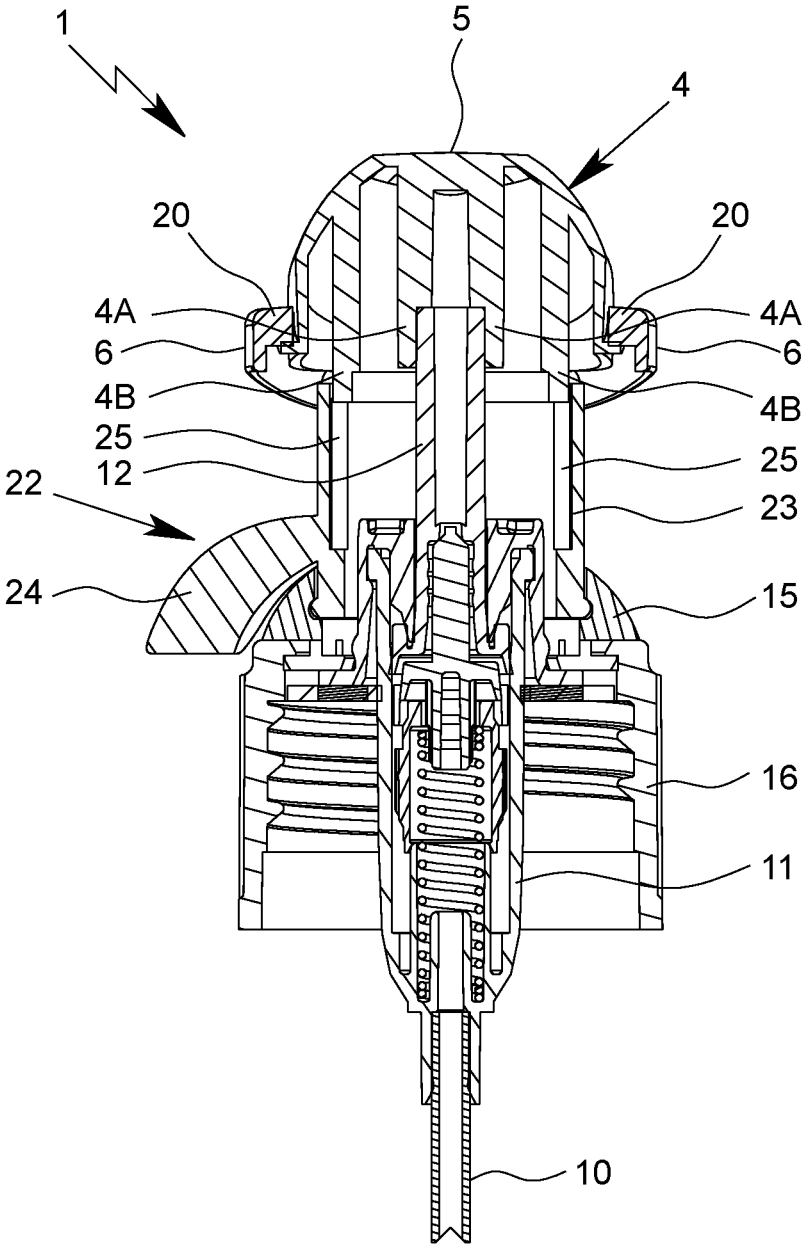
Figure 12:
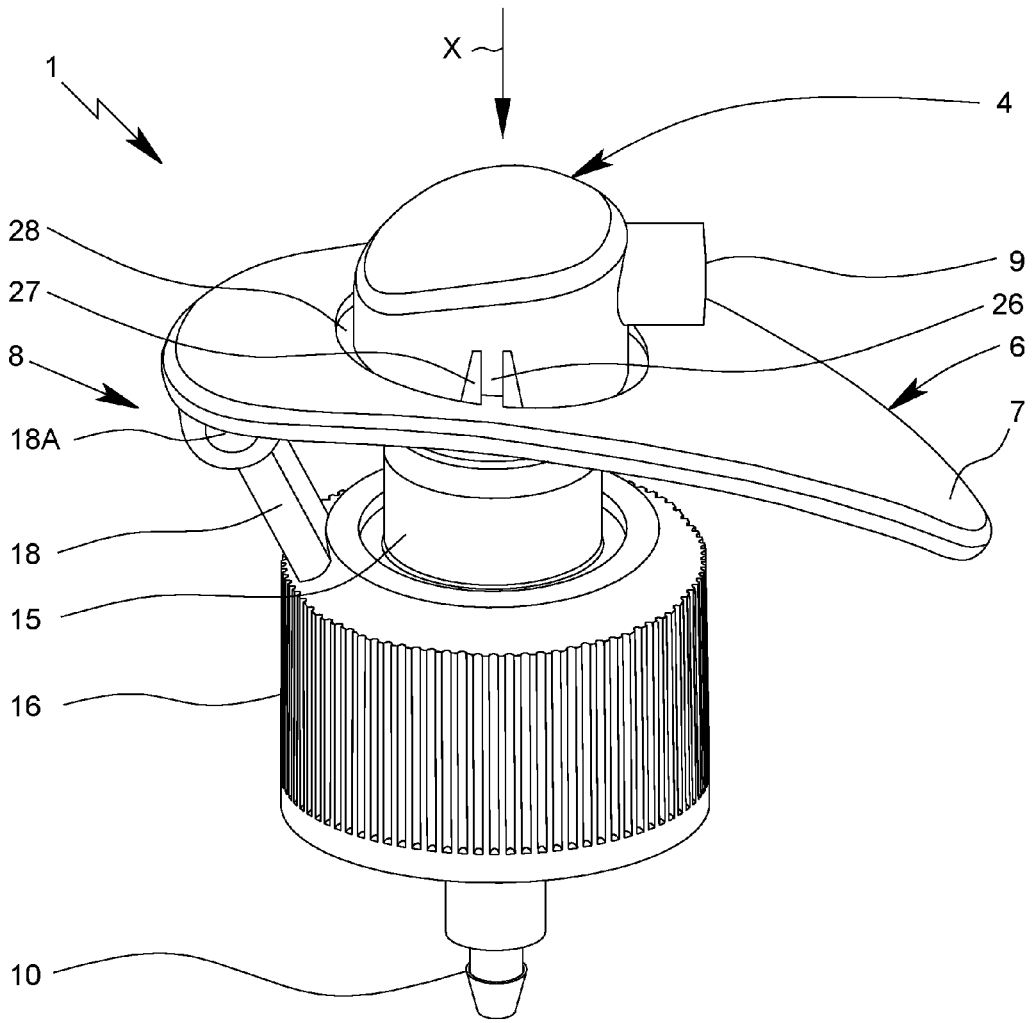
Figure 13:
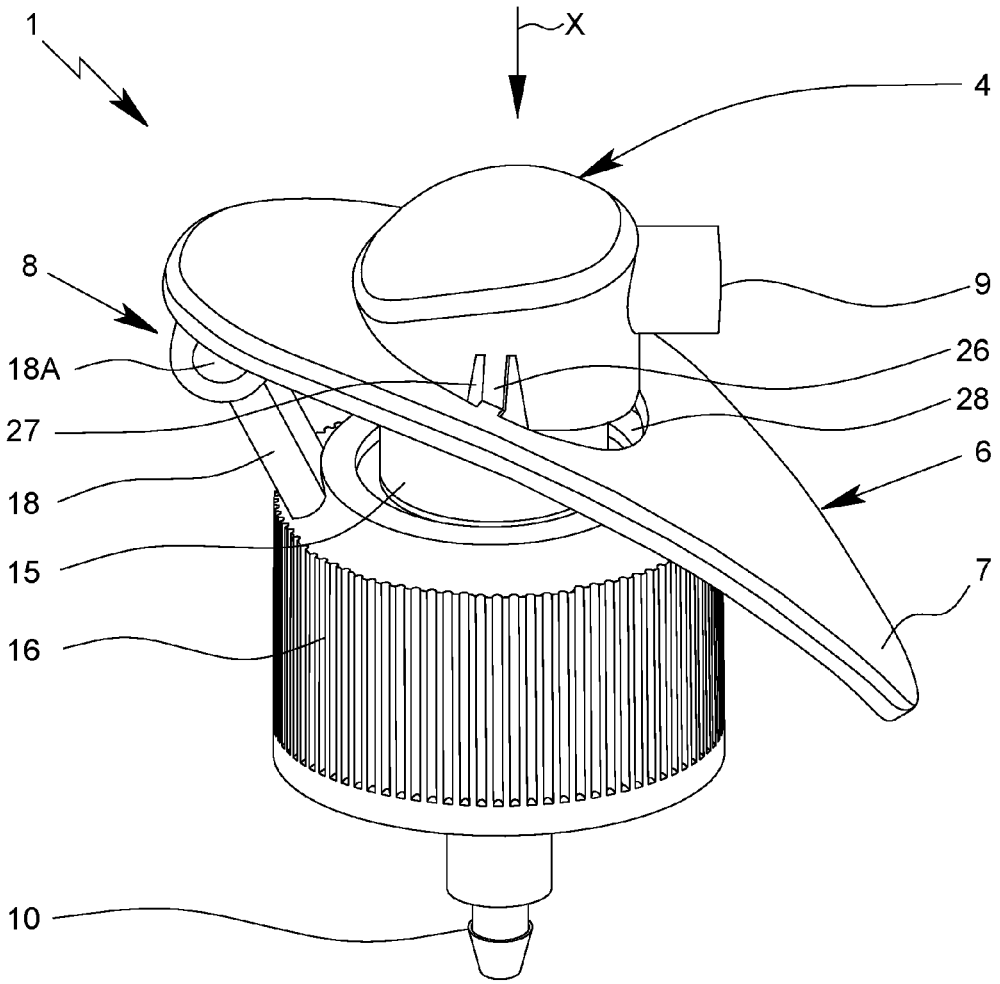
Figure 14:
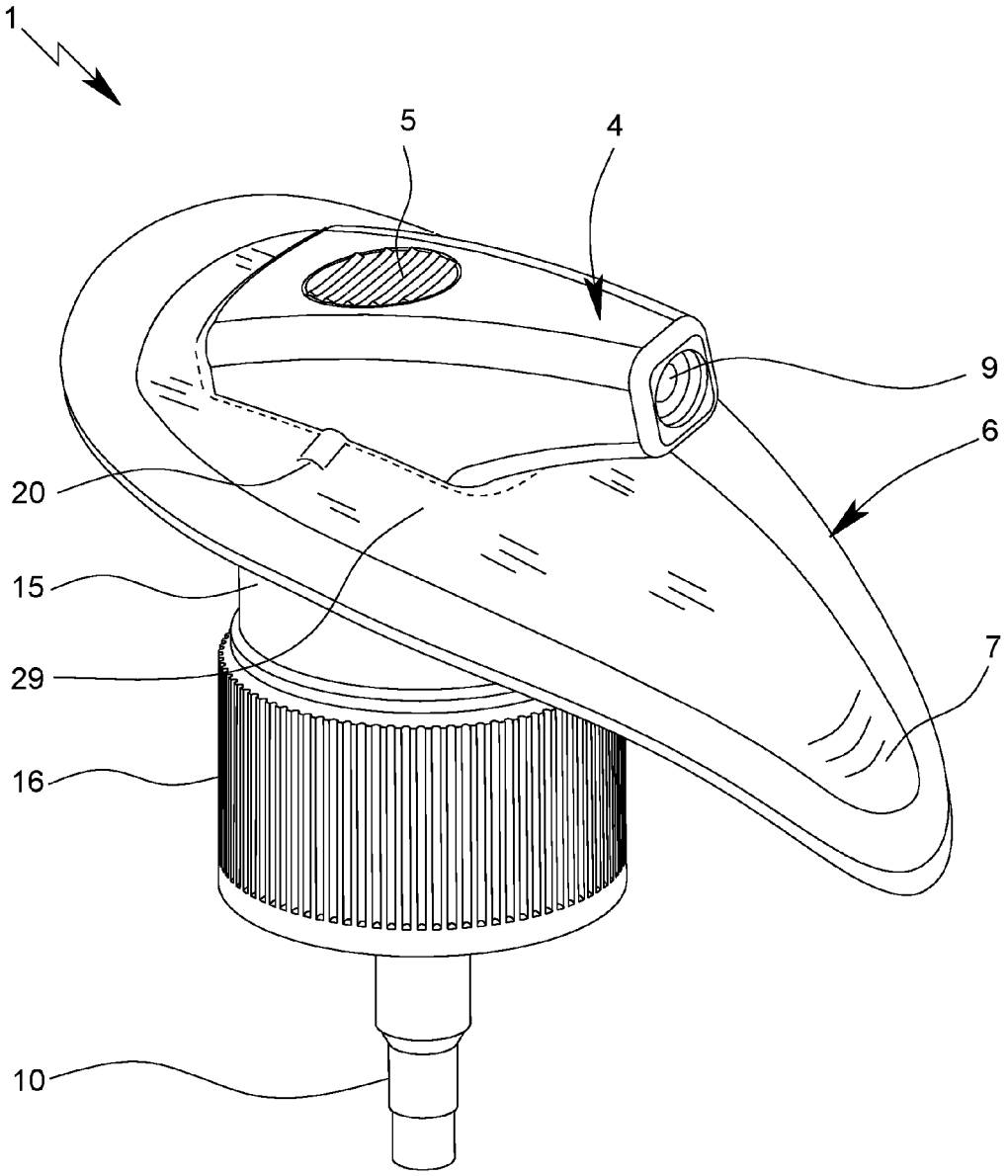

Additional advantages, features, characteristics and aspects of the present invention follow from the claims and the following description of preferred embodiments with reference to the drawing. It shows:

FIG. 1 a schematic partial section of a proposed pump according to a first embodiment with a liquid container in the actuated state;

FIG. 2 a perspective view of the pump in the actuated state;

FIG. 3 a schematic section of the pump in the actuated state;

FIG. 4 a schematic representation of a second actuation element with a linkage on the pump;

FIG. 5 a perspective view of the pump in the non-actuated state;

FIG. 6 a perspective view of the second actuation element of the pump;

FIG. 7 a schematic representation of a first actuation element or head of the pump;

FIG. 8 a side view of a proposed pump according to a somewhat modified, second embodiment in the non-actuated state;

FIG. 9 shows a side view of the pump according to FIG. 8 in the actuated state;

FIG. 10 a vertical section of the pump along line X-X of FIG. 8 in the locked state;

FIG. 11 a vertical section of the pump in the non-locked state;

FIG. 12 a perspective view of a proposed pump according to a third embodiment in the non-actuated state;

FIG. 13 a perspective view of the pump according to FIG. 12 in the actuated state; and FIG. 14 a perspective view of a proposed pump according to a fourth embodiment in the non-actuated state.

In the figures, the same reference symbols are used for same and similar elements and components, with corresponding characteristics and features arising even if a repeated description has been omitted.

FIG. 1 shows a proposed pump 1. The proposed pump 1 is preferably attached to a liquid container 3 containing a liquid 2, such as hair spray, or can be connected thereto, particularly by snapping or screwing on.

The pump 1 preferably has a first actuation element 4 with a first actuation area 5 for manual actuation by a user (not shown).

The first actuation element 4 preferably forms a delivery head 4 of the pump 1 or vice versa. The terms "first actuation element" and "delivery head" must therefore preferably be understood as synonyms.

Preferably, the pump 1 is constructed such that through a force effect on the first actuation area 5, the actuation element or delivery head 4 can be manually moved, particularly depressed, in a first actuation direction X and, thus, the pump 1 can be actuated and/or the liquid 2 can be pumped.

The pump 1 is shown in the actuated state in FIG. 1. Through actuation of the pump 1, the liquid 2 is delivered as a stream S, particularly as a spray stream or atomized spray, as indicated in FIG. 1.

The pump 1 preferably has a second actuation element 6. This is a part that is separate from the first actuation element or delivery head 4 and/or is particularly swivelable. The pump 1 can preferably be actuated in an alternative manner by means of the second actuation element 6.

In particular, the second actuation element 6 has a second actuation area 7 for a user (not shown). This second actuation area 7 is advantageously separated, particularly spaced apart from the first actuation area 5.

Preferably, the second actuation element 6 can be manually moved or swiveled through the force effect on the second actuation area 7 in a second direction of actuation Y that is preferably different from the first direction of actuation X. This second actuation in direction Y is preferably arcuate. The arcuate profile results from the swiveling movement of the second actuation element 6.

Preferably, the pump 1 has a mechanism, here a lever mechanism, for optional or alternative actuation. Particularly, the second actuation element 6 preferably forms the lever mechanism 8 together with the first actuation element or delivery head 4 or a pump element 12 and/or with another component of the pump 1. It is preferably another component around a housing of the pump 1.

The pump is also shown in FIG. 2 in the actuated state, i.e., with depressed delivery head 4 or second actuation element 6, but without liquid container 3.

As can be seen in FIG. 2, the pump 1 or the delivery head 4 of the pump 1 preferably has a nozzle 9 for spraying the liquid 2. The nozzle 9 is preferably associated with the first actuation element or delivery head 4. In the present depicted example, the nozzle 9 is preferably arranged or formed in or on the first actuation element or delivery head 4.

The proposed pump 1 preferably has a suction pipe 10 for sucking liquid 2 from the container 3, as indicated in FIG. 1.

FIG. 3 shows a schematic section of the pump 1 in the actuated state, that is, with depressed first and/or second actuation element 4 or 6.

The pump 1 preferably has a pump housing 11 and an associated pump element 12. The pump element 12 can be moved relative to the pump housing 11, particularly moved linearly or depressed, in order to pump the liquid 2. Preferably, the pump element 12 is coupled with a pump plunger (not shown) of the pump 1 or forms same. Especially preferably, the pump element 12 is biased or returnable into its upper, non-depressed or non-actuated position by means of a return spring or the like (not shown).

The pump element 12 is preferably tubular and/or hollow and/or forms a delivery channel for the pumped liquid 2.

Preferably, the delivery head 4 of the pump 1 is connected at least fluidly and particularly mechanically, especially preferably non-detachably, to the pump element 12. In the depicted example, the delivery head 4 is connected to and/or plugged onto the pump element 12 particularly by means of a connection area 4A. For example, an interference fit or a force fit can be achieved in this way. However, other structural solutions are also possible.

A first channel 13 and, optionally, a second channel 14 preferably adjoin the connection area 4A or the pump element 12 in the delivery head 4 in order to convey the pumped liquid 2 (not shown in FIG. 3) to the nozzle 9.

The nozzle 9 is especially preferably formed by a nozzle member plugged into the delivery head 4. However, other structural solutions are also possible.

The pumped liquid 2 is delivered via the nozzle 9 and particularly atomized, as indicated in FIG. 1.

The delivery direction of the pump 1 or of the delivery head 4 or of the nozzle 9 preferably runs transversely, particularly at least substantially perpendicularly, to the first direction of actuation X or to the depression action or to the pumping direction.

In particular, the delivery direction runs at least substantially horizontally if the pump 1 is held at least substantially vertically with the associated liquid container 3, which corresponds to the preferred or normal operating position of the pump 1.

The actuation of the pump 1 or of the pump element 12 is preferably achieved either directly through manual or direct depression of the delivery head 4 or pump element 12 or indirectly via a mechanism, such as the lever mechanism 8, or through actuation or swiveling of the second actuation element 6.

The linear actuation or the linear depression thus occurs particularly in the first direction of actuation X or, in the operating position, at least substantially vertically. The alternative actuation via the lever mechanism 8 preferably occurs through a swiveling movement in the second direction of actuation Y and/or particularly obliquely or inclined toward the first direction of actuation X or toward vertical in the operating position of the pump 1.

The actuation via the second actuation element 6 or lever mechanism 8 can particularly be used to achieve a slower and/or easier actuation of the pump 1 and/or a higher pumping pressure upon actuation of the pump 1 in comparison to the (direct) linear actuation through depression of the pump element 12 or delivery head or first actuation element 4.

Preferably, the first actuation area 5 is arranged at least substantially in extension of or above the pump element 12 or pump housing 11 in order to prevent or at least to minimize twisting or tilting of the pump element 12 during actuation.

Preferably, the first actuation area 5 is arranged or formed on the upper side and/or flat side of the delivery head or actuation element 4.

Especially preferably, the actuation area 5 is provided with a corresponding color and/or structure, for example ribbing, and/or another material, a coating, a mark or the like, so as to be intuitively or palpably identifiable for a user (not shown). The same preferably applies to the second actuation area 7 on the second actuation element 6.

The delivery head or the first actuation element 4 preferably projects laterally over the pump 1 or the pump housing 11 and/or an outer casing 15 of the pump 1.

In the depicted example, the pump 1 or the outer casing 15 and/or pump housing 11 can preferably be connected to the associated liquid container 3 by means of a connecting element 16, particularly by screwing. However, other structural solutions are also possible. For example, the pump 1 can also be connected or connectable to the liquid container 3 in a locking or other manner.

In the depicted example, the pump housing 11 or outer casing 15 is preferably covered at least substantially completely from above by the first actuation element or delivery head 4 and/or second actuation element 6.

The second actuation element 6 preferably projects laterally down or out, particularly in the direction of or on the side of the delivery direction of the pump 1 or nozzle 9 and/or obliquely downward in the normal operating position of the pump 1.

One possible and preferred embodiment of the lever mechanism 8 and the supporting or linkage of the second actuation element 6 will be explained in further detail below.

The second actuation element 6 is preferably supported or linked in a swiveling manner on the pump 1 or pump housing 11 or outer casing 15.

In the depicted example, the swiveling support is preferably achieved as a result of the fact that the second actuation element 6 has at least one bearing element 17 with a bearing eye 17A, with a bearing pin 18A engaging in the bearing eye 17A that is preferably held or formed by a retaining arm or retaining element 18 in the depicted example, as indicated schematically in FIG. 3. The retaining arm or the retaining element 18 is preferably arranged on the pump 1 or pump housing 11 or outer casing 15 or held by same.

Especially preferably, the retaining element 18 projects downward in the manner of an arm and/or laterally from the pump 1 or the outer casing 15 and/or extends laterally on or to the delivery head or first actuation element 4, particularly on the side opposite the delivery side or nozzle side.

Preferably, the second actuation element 6 is swivel-mounted on the side of the delivery head or first actuation element 4 facing away from the delivery side or nozzle side.

The swivel-mount is preferably constructed such that the second actuation element 6 can be connected to the pump 1 in a locking manner, particularly snapped on. In the depicted example, this is achieved through the fact that at least one mounting pin 18A is appropriately chamfered on its free end. In addition or alternatively, the bearing element 17 is preferably embodied as an elastic or tab-like section in order to enable the bearing pin 18A to engage or snap into the associated bearing eye 17A during assembly through lateral deflection. However, other structural solutions are also possible.

In the depicted example, the second actuation element 6 preferably has two mutually spaced-apart bearing element 17, each with a bearing eye 17A, with the retaining element 18 preferably extending between these bearing element 17 and engaging with oppositely projecting bearing pins 18A into the associated bearing eyes 17A, as indicated in the schematic top view without dispensing head 4 in FIG. 4.

To facilitate snapping-on and assembly, an insertion chamfer 17B can also be provided on the support members or sections 17 in addition to or as an alternative to chamfering of the mounting pins 18A, as indicated in FIG. 4.

However, other structural solutions for the swivel-mount are also possible. For example, the bearing pins 18A can alternatively also be formed on the second actuation element 6, and one or more bearing eyes 17A can be formed on the housing of the pump 1 or retaining element 18, for example. Moreover, it is also possible for a separate bearing pin 18A, a film hinge or the like to be used for the articulated connection of the second actuation element 6 to the pump 1.

The pump 1 or the delivery head or the first actuation element 4 preferably engages through the second actuation element 6 or particularly extends upward beyond the latter. Preferably, the second actuation element 6 has an opening or through hole 19 for this purpose, as indicated in FIG. 4. The delivery head 19 or the first actuation element 4 projects through this through hole 19, particularly upward or counter to the direction of actuation X beyond the second actuation element 6, as indicated in the perspective representation according to FIG. 5. The pump 1 is shown here in the non-actuated state. Particularly, neither the delivery head 4 nor the second actuation element 6 is depressed or actuated here.

Upon being released, and in the non-actuated state, the pump 1 preferably assumes the abovementioned position. In particular, by virtue of the previously mentioned returning means, such as a return spring in the pump housing 11 and/or on or in the pump 1, it is achieved that, when it is not being actuated, the pump element 12 moves back into the non-actuated position with the delivery head or first actuation element 4, whereby the second actuation element 6 is also lifted and thus moved back into its non-actuated initial position, as shown in FIG. 5.

To implement the lever mechanism 8, and to have the second actuation element 6 engage directly or indirectly on the pump element 12 in the depicted example, on the delivery head or first actuation element 4, thus indirectly the second actuation element 6 preferably has at least one coupling element 20 in the depicted example, particularly two coupling elements 20 arranged on opposing sides of the through hole 19 as indicated in the perspective view of the second actuation element 6 according to FIG. 6.

The coupling elements 20 are particularly embodied in the manner of projections or pins and can engage on bearing surfaces or counter-elements 21 on the delivery head or first actuation element 4 in order to convert the swiveling movement of the second actuation element 6 in the Y direction into the linear pumping movement in the X direction or to move the second actuation element 4 and hence the pump element 12 downward, i.e., to depress it.

As a result of the lever ratios, a commensurate reduction is achieved, whereby the actuation of the lever mechanism 8 or second actuation element 6 for the pumping of liquid 2 or for the actuation of the pump 1 is enabled very easy. Particularly, a reduction ratio of at least 2:1 or greater is achieved here.

In the depicted example, the counter-elements 21 are preferably formed on opposing sides or outer sides of the delivery head 4 and/or embodied in the manner of bearing shells.

Preferably, a kind of loose coupling is achieved between the second actuation element 6 and the delivery head 4 or via the coupling elements 20 and counter-elements 21 such that only a downward movement in the X direction is exerted on the delivery head, the first actuation element 4 and/or the pump element 12, and/or that a relative movement of the second actuation element 6 or of the coupling elements 20 perpendicular to the swivel-mount axis and perpendicular to the first direction of movement X is made possible in order to transfer as little tilting moment as possible to the first actuation element 4 or pump element 12 during the actuation of the second actuation element 6 or lever mechanism 8. This loose coupling is preferably achieved in the depicted example as a result of the fact that the counter-bearing elements 21 form a slide bearing surface for the abutting coupling elements 20 extending transversely to the direction of motion X and substantially toward the axis of the swivel-mount of the second actuation element 6.

However, other structural solutions are also possible. For example, the lever mechanism 8 can also have an additional lever arm or articulated arm or the like, particularly to compensate for the aforementioned transverse movement.

Furthermore, it should be noted that, instead of two coupling elements 20 and counter-elements 20, it is also possible to use only one of each such element.

Moreover, alternatively or in addition, it is also possible, for example, to use a slotted guide to convert the swiveling movement of the second actuation element 6 into a linear movement and/or to couple the second actuation element 6 with the delivery head, first actuation element 4 or pump element 12.

The proposed pump 1 is particularly used to pump a cosmetic liquid 2, such as hair spray or the like. However, other applications are also possible in principle.

The proposed pump 1 enables a very universal or optional actuation by means of a linear movement or swiveling movement.

The proposed pump 1 enables optional actuation by means of the first actuation element or delivery head 4 or actuation area 5 on the one hand and of the second actuation element 6 or actuation area 7 on the other hand.

The proposed pump 1 enables optional direct or linear actuation on the one hand and indirect actuation via a mechanism, particularly the lever mechanism 8, on the other hand.

The proposed pump 1 also enables simultaneous actuation via two different actuation elements 4, 6 or actuation areas 5, 7 as needed, one example being simultaneous actuation by means of two hands of a user (not shown).

Preferably, the pump mechanism is received in encapsulated fashion in the pump housing 11. The pump mechanism received in the pump housing 11 preferably has a return element.

Particularly due to the return element, the pump 1 is preferably constructed such that the first actuation element 4 and/or second actuation element 6 is or are held in an initial position without external force effect and/or returns or return to it. In FIG. 4, the pump 1 is shown in this initial position, i.e., in the non-actuated state.

The second actuation element 6 preferably encloses the first actuation element 4 in the manner of a ring or collar.

The assembly of the second actuation element 6 on the pump 1 can be achieved in a simple manner particularly by first guiding the second actuation element 6 over the first actuation element 4 from the direction of the nozzle 9. The loose coupling is then produced. Preferably, the coupling elements 20 are made to engage with the counter-elements 21 for this purpose. Finally, the support member 17 is made to engage and lock with the retaining element 18 in order to produce the swivel-mount.

The second actuation element 6 is preferably reduced in its relative mobility to a swiveling movement about its pivot as a result of its linkage or swivel-mounting on the pump 1 or on the outer casing 15. What is more, this swiveling movement is also limited by the coupling elements 20 engaging in the coupling counter-elements 21. Any additional movement that brings the coupling elements 20 and counter-elements 21 toward each other beyond their contact point has the consequence that the second actuation element 6 depresses the first actuation element 4 or the delivery head and/or the pump element 12 along the first direction of actuation X, this bringing about the pumping of the liquid 2.

Preferably, the upward swinging of the second actuation element 6 counter to the second direction of actuation Y is prevented or limited by the first actuation element 4.

Particularly, a manually operated pump 1 and a method for pumping a preferably cosmetic liquid 2 are thus proposed in which actuation is performed either by manual linear actuation or by swiveling actuation using a lever mechanism 8.

A somewhat modified, second embodiment of the proposed pump 1 is explained in further detail below with reference to the other figures, with particular attention being paid to substantial differences and new aspects. The preceding remarks and explanations therefore apply particularly in analogous or supplementary fashion, even if this is not explicitly mentioned.

FIG. 8 shows the pump 1 according to the second embodiment in a side view in the non-actuated state. FIG. 9 shows the pump 1 in a corresponding side view but in the actuated state.

The pump 1 preferably has a locking device 22 in order to enable blocking or locking of the pump 1 against actuation when in a locked state, as shown in FIG. 8. The locking device 22 preferably acts between the delivery head or first actuation element 4 on the one hand and a housing part, particularly the outer casing 15 or connecting element 16 or pump housing 11 on the other hand in order to block the delivery head or first actuation element 4 from being depressed in the locked state, thus locking the pump 1 against actuation.

The locking device 22 preferably has a locking element 23 and/or handle 24 associated therewith or formed thereon.

The locking element 23 is preferably annular or sleeve-like or collar-like.

The handle 24 is preferably embodied as a grip and/or projects radially. However, other structural solutions are also possible. For example, the handle 24 can also be formed by a commensurately shaped surface of the locking element 23 provided with raised areas and/or recesses or of another component of the locking device 22.

FIG. 8 shows the pump 1 or locking device 22 in the locked state. Here, the handle 24 preferably points forward or in the delivery direction and/or in the direction of a projecting or free section or end of the second actuation element 6 or swivel lever of the pump 1.

As needed, the locking device 22 or the locking element 23 or the handle 24 can, in addition or alternatively, also block the second actuation element 6 or the swivel lever against actuation or swiveling in the locked state, particularly by virtue of the fact that the handle 24 sufficiently or completely blocks the depression or swiveling of the swivel lever in the locked state.

FIG. 9 shows the pump 1 and locking device 22 in the non-locked state. The handle 24 is now located particularly on a side of the pump 1 or is rotated to the side of the pump 1.

The locking element 23 is preferably rotatable, particularly about an axis that is vertical in the normal operating position or about an axis that is skew or perpendicular to the swivel axis of the swivel lever or second actuation element 6. The axis of rotation runs particularly in the direction of the linear direction of actuation or central axis of the pump 1, in this case the first direction of actuation X or pumping direction.

The handle 24 is preferably swivelable, especially preferably by rotating the locking element 23 or vice versa.

The handle 24 can particularly be swiveled on a horizontal plane in the normal operating position of the pump 1. In the normal operating position of the pump 1, the direction of actuation X preferably runs at least substantially vertically, and/or the main delivery direction of the pump 1 is at least substantially in the horizontal direction.

FIG. 10 shows the pump 1 according to FIG. 8, i.e., in the non-actuated, locked state, in a vertical section along line X-X. FIG. 11 shows the pump 1 in the non-locked state in a corresponding vertical section.

The pump 1 according to the modified second embodiment preferably has a modified outer casing 15, which is particularly annular and/or holds the locking element 23 in a rotatable manner. Particularly, the locking element 23 is fixed on the pump 1 in the axial direction, but in order to switch between the locked state and non-locked state and vice versa, it is held or supported in a rotatable manner. This is achieved in the exemplary embodiment particularly through the fact that the locking element 23 is held in a commensurately form-fitting manner in the area of its lower end in the axial direction by the pump 1 or the housing thereof, here the outer casing 15. However, other structural solutions are also possible.

The locking element 23 extends with a preferably hollow cylindrical or sleeve-like section toward the delivery head or first actuation element 4. The section and the delivery head 4 can be pushed (farther) into one another in the non-locked and actuated state. In particular, in the non-locked state, the delivery head 4 can be inserted or pushed with a counter-section 4B into the locking element 23 or the sleeve section thereof, especially preferably by engaging in one or more axial grooves 25, which are preferably formed on the inside of the sleeve-shaped section of the locking element 23 in the depicted example, as indicated in FIG. 11. However, other structural solutions are also possible.

A modified, third and fourth embodiment of the proposed pump 1 is explained in further detail below with reference to the other figures, with particular attention being paid to substantial differences and new aspects. The preceding remarks and explanations therefore apply particularly in analogous or supplementary fashion, even if this is not explicitly mentioned.

FIG. 12 shows a perspective view of the proposed pump 1 according to a third embodiment in the non-actuated state.

In the embodiment depicted in FIG. 12, the delivery head 4 is preferably integrally formed with the second actuation element 6 or forms a structural unit.

Especially preferably, the delivery head 4 is connected to the actuation element 6 via at least one particularly bar-, bridge- or bolt-like connecting part 26.

The connecting part 26 is preferably elastic or flexible, particularly rotatable and/or bendable, in order to enable a relative or swiveling movement between the delivery head 4 and the actuation element 6, particularly the swivel lever of the actuation element 6.

The connecting part 26 thus forms a preferably "non-detachable" coupling of the second actuation element 6 with the delivery head 4, the connecting part 26 being constructed such that, in particular, the conversion of a swiveling movement of the second actuation element 6 into a linear or at least approximately linear movement of the delivery head 4 or pump element 12 (not shown in FIG. 12) can advantageously be achieved.

Especially preferably, the connecting part 26 runs at least substantially parallel and/or orthogonal to a surface or side or to a tangential plane of the surface or side of the delivery head 4.

In the depicted embodiment, the connecting part 26 preferably has at least substantially an L shape.

Beginning at the delivery head 4, the connecting part 26 preferably first runs substantially parallel to or within the surface or side of the delivery head 4 and then bends or curves approximately at a right angle radially away from the delivery head 4 in order to finally lead or transition into the second actuation element 6. However, other structural solutions are also possible, particularly with respect to the connecting part 26 or the course of the connecting part 26, in which the connecting part 26 preferably runs at least substantially radially and/or axially.

Alternatively, the connecting part 26 is at least substantially U-shaped. The connecting part 26 can thus particularly run initially at least substantially axially, then radially and finally axially again to the surface or side of the delivery head 4. In this way, the connecting part 26 has an especially long range or length and enables a high level of mobility or flexibility with respect to the relative or swiveling movement between the delivery head 4 and the actuation element 6.

Especially preferably, the connecting part 26 advantageously has a direction-dependent elasticity and/or a direction-dependent modulus of elasticity.

For example, the amount of the modulus of elasticity in the axial direction can be greater than in a direction approximately orthogonal to the direction of actuation X and/or than in the radial direction to the surface or side of the first actuation element or delivery head 4. This ensures in particular that, despite the relative movement between the delivery head 4 and the second actuation element 6, a lag-free and direct force transmission from the actuation element 6 to the delivery head 4 is achieved.

Particularly, the coupling of the second actuation element 6, i.e., of the swivel lever, with the delivery head or first actuation element 4 is constructed by means of the connecting part 26 such that a relatively stiff or solid coupling or force transmission is achieved in the axial direction or in the direction of depression, whereas a softer coupling or connection is achieved in the transverse direction or radial direction.

In the embodiment depicted in FIG. 12, the delivery head 4 preferably has a particularly slot- or gap-like recess 27, particularly as a movement space of the connecting part 26 during the swiveling or actuation of the actuation element 6.

Especially preferably, the recess 27 advantageously opens or widens such that sufficient space or movement space is present for movement, particularly rotation and/or bending, of the connecting part 26 in every actuating position of the pump 1, particularly upon complete actuation of the actuation element 6.

Other structural solutions are also possible, however. Particularly, the actuation element 6 can additionally or alternatively have a recess 27.

Preferably, the actuation element 6 engages on opposing sides on the delivery head 4.

Especially preferably, the actuation element 6 is connected to the delivery head 4 via two connecting parts 26 opposing one another on the delivery head 4.

In particular, the connecting parts 26 are located on the side of the pump 1. Other structural solutions are also possible, however, in which the connecting parts 26 are preferably located on the side of the delivery side or nozzle side or on the side opposite thereto.

FIG. 13 shows a perspective view of the pump 1 according to FIG. 12 in the actuated state. Upon actuation or depression of the actuation element 6, the flexible connecting part 26 rotates and/or bends such that only a downward movement in the X direction is exerted on the delivery head 4 and/or the pump element 12 (not shown in FIGS. 12 and 13), and/or that a relative movement of the second actuation element 6 perpendicular to the swivel-mount axis and perpendicular to the first direction of movement X is made possible in order to transfer as little tilting moment as possible to the first actuation element 4 and/or pump element 12 during the actuation of the second actuation element 6 or lever mechanism 8.

Particularly, the connecting part 26 is designed so as to permit actuation of the actuation element 6 of any frequency without damage, such as plastic deformations or cracks in or on the connecting part 26.

In the embodiment illustrated in FIGS. 12 and 13, the actuation element 6 encloses the delivery head 4 in the manner of a ring and/or collar. Other structural solutions are also possible, however.

Especially preferably, the actuation element 6 encloses the delivery head 4 at the lower end of the delivery head 4 in the manner of a ring and/or collar. However, it is also conceivable for the actuation element 6 to be located on the upper end of the delivery head 4 and/or to extend over or on the upper end of the delivery head 4.

For the relative or swiveling movement between the delivery head 4 and the actuation element 6, the pump 1 preferably has an interspace 28 that is located between the delivery head 4 and the actuation element 6.

The connecting part 26 preferably bridges over the interspace 28 in order to connect the actuation element 6 to the delivery head 4.

The geometry and/or dimensions of the interspace 28 preferably changes or change upon actuation of the actuation element 6. Particularly, the interspace 28 increases on the delivery side or nozzle side and becomes smaller on the side opposite the delivery side or nozzle side upon actuation of the actuation element 6.

FIG. 14 shows a perspective view of the pump 1 according to a fourth embodiment in the non-actuated state.

Preferably, the actuation element 6 and/or a part that can be moved relative to the actuation element 6, such as the liquid container 3 (not shown in FIG. 14), the delivery head 4, the outer casing 15 and/or the connecting element 16, are or is provided with a flexible or elastic covering or layer 29.

In the embodiment depicted in FIG. 14, the actuation element 6 and/or the delivery head 4 or the connecting part 26 are provided with the covering or layer 29 and covered at least partially.

The layer 29 preferably covers and/or fills—at least partially—an interspace, such as a gap, space, recess, or the like, between the actuation element 6 and the part that can be moved relative to the actuation element 6, particularly the interspace 28 between the actuation element 6 and the delivery head 4.

In particular, structural solutions are also conceivable in which the layer 29 additionally or alternatively covers or bridges over the space or interspace between the actuation element 6 and the liquid container 3 (not shown in FIG. 14), the outer casing 15 or the connecting element 16, preferably in the form of a coating, wrap or as cladding of the pump 1.

In the embodiment illustrated in FIG. 14, the layer 29 encloses the delivery head 4 in the manner of a ring and/or collar. Particularly, the layer 29 encloses the delivery head 4 such that the layer 29 covers and/or fills the interspace 28 at least partially, as shown schematically in FIG. 14 by dashed lines.

In the depicted embodiment, the layer 29 is particularly injection-molded against the actuation element 6. Especially preferably, the layer 29 is injection-molded by means of so-called bi-injection against the actuation element 6 or another part. During bi-injection, the layer 29 is preferably injected into the same injection mold in which the actuation element 6 or another part was first injected.

However, other structural solutions are also possible in which the layer 29 is alternatively or additionally injection-molded against the part that can be moved relative to the actuation element 6, particularly the delivery head 4.

Preferably, the layer 29 is softer, more elastic, more flexible and/or thinner-walled than the actuation element 6 and/or the part that can be moved relative to the actuation element 6.

The layer 29 is particularly constructed such that the layer 29 preferably deforms, particularly stretches or extends and/or is compressed and/or folded or arches, elastically or flexibly during the actuation of the actuation element 6.

Especially preferably, the layer 29 covers and/or fills—at least partially—preferably an interspace, particularly the interspace 28, between the actuation element 6 and the part that can be moved relative to the actuation element 6 independently of relative and swiveling movements between the actuation element 6 and the part that can be moved relative to the actuation element 6, that is, particularly both in the actuated and in the non-actuated state of the pump 1.

In the depicted embodiment, the layer 29 is injection-molded or formed against the actuation element 6 such that the layer 29 is also embodied as a second actuation area 7 of the actuation element 6 or forms same. Other structural solutions are also possible, however.

Preferably, the delivery head 4 and the actuation element 6 are injected as injection-molded components in one piece.

Individual aspects and features of the different embodiments can also be implemented independently of each other or in any combination.

LIST OF REFERENCE SYMBOLS

1 pump
2 liquid
3 liquid container
4 first actuation element/delivery head
4A connection area
4B counter-section
5 first actuation area
5A connection area
6 second actuation element
7 second actuation area
8 lever mechanism
9 nozzle
10 intake pipe
11 pump housing
12 pump element
13 first channel
14 second channel
15 outer casing
16 connecting element
17 bearing element
17A bearing eye
17B insertion chamfer
18 retaining element
18A bearing pin
19 through hole
20 coupling element
21 counter-element
22 locking device
23 locking element
24 handle
25 axial groove
26 connecting part
27 recess
28 interspace

29 layer
S stream
X first direction of actuation
Y second direction of actuation

The invention claimed is:

1. A manually operated pump for dispensing a liquid from an associated liquid container, wherein the pump has a first actuation element with a first actuation area and is constructed such that the first actuation area can be moved manually in a first direction of actuation to actuate the pump, wherein the pump has a second swivable actuation element with a second actuation area separated from the first actuation area, wherein a pump element of the pump can selectively be depressed manually and linearly via the first actuation area or actuated manually via a lever mechanism by swiveling the second actuation element, wherein the second actuation element has a through hole through which the first actuation element projects upward or counter to the direction of actuation beyond the second actuation element, and wherein the second actuation element has at least one coupling element arranged on one side of the through hole slidingly engaging on an associated bearing surface or counter element of the first actuation element in order to convert the swiveling movement of the second actuation element into the linear pumping movement of the first actuation element.

2. The pump as set forth in claim 1, wherein the pump has a pump housing, with the pump element being movable relative to the pump housing to pump the liquid.

3. The pump as set forth in claim 1, wherein the pump has a nozzle for spraying the liquid, wherein the nozzle is associated with the first actuation element or delivery head or arranged on the first actuation element.

4. The pump as set forth in claim 1, wherein the first actuation element is coupled with the pump element, and arranged on the pump element and/or non-detachably attached to the pump element.

5. The pump as set forth in claim 1, wherein the swiveling movement of the second actuation element brings about a linear movement of the first actuation element or delivery head or pump element upon depression of the second actuation area.

6. The pump as set forth in claim 1, wherein the second actuation element encloses the first actuation element in the manner of a ring and/or collar.

7. The pump as set forth in claim 1, wherein the second actuation element is mountable in a locking manner on an outer casing of the pump via a snap connection.

8. The pump as set forth in claim 1, wherein the first actuation element is constructed as a delivery or spray head.

9. The pump as set forth in claim 1, wherein the second actuation element is constructed as a swivel lever.

10. The pump as set forth in claim 1, wherein the pump has a locking device for locking the pump against actuation.

11. The pump as set forth in claim 1, wherein two coupling elements are arranged on opposing sides of the through hole and/or wherein two counter-elements or bearing surfaces are formed on opposing sides of the first actuation element.

12. The pump as set forth in claim 1, wherein the coupling element is embodied as a pin or projection and/or wherein the counter element is embodied as a bearing shell.

13. The pump as set forth in claim 1, wherein first actuation area is provided with a structure, wherein the structure is one of a ribbing, a coating or a mark as to be intuitively or palpably identifiable for a user.

14. A manually operated pump for dispensing a liquid from an associated liquid container, wherein the pump has a first actuation element with a first actuation area and is constructed such that the first actuation area can be moved manually in a first direction of actuation to actuate the pump, wherein the pump has a second actuation element with a second actuation area separated from the first actuation area, wherein a pump element of the pump can selectively be depressed manually and linearly via the first actuation area or actuated manually via a lever mechanism by swiveling the second actuation element, wherein the second actuation element is swivel-mounted on an outer casing of the pump via a snap connection; and wherein the second actuation element has a through hole through which the first actuation element projects upwardly, or counter to the direction of actuation, beyond the second actuation element.

15. The pump as set forth in claim 14, wherein the second actuation element has at least one bearing element with a bearing eye engaging in a snap-fit manner with a mounting pin of a retaining arm of the outer casing.

16. The pump as set forth in claim 15, wherein the mounting pin is chamfered on its free end so that the second actuation element can be snapped on the outer casing.

17. The pump as set forth in claim 15, wherein the second actuation element has two mutually spaced apart bearing elements with a bearing eye each, wherein the retaining arm has oppositely arranged bearing pins associated to each bearing eye.

18. A manually operated pump for dispensing a liquid from an associated liquid container, wherein the pump has a first actuation element with a first actuation area and is constructed such that the first actuation area can be moved manually in a first direction of actuation to actuate the pump, wherein the pump has a second swivable actuation element with a second actuation area separated from the first actuation area, wherein a pump element of the pump can selectively be depressed manually and linearly via the first actuation area or actuated manually via a lever mechanism by swiveling the second actuation element, wherein the second actuation element has a through hole through which the first actuation element projects upward or counter to the direction of actuation beyond the second actuation element, wherein the second actuation element has at least one coupling element arranged on one side of the through hole slidingly engaging on an associated bearing surface or counter element of the first actuation element in order to convert the swiveling movement of the second actuation element into the linear pumping movement of the first actuation element, and wherein the second actuation element is swivel-mounted on an outer casing of the pump via a snap connection.

19. The pump as set forth in claim 18, wherein two coupling elements are arranged on opposing sides of the through hole and/or wherein two counter-elements or bearing surfaces are formed on opposing sides of the first actuation element.

20. The pump as set forth in claim 18, wherein the coupling element is embodied as a pin or projection and/or wherein the counter element is embodied as a bearing shell.

21. The pump a set forth in claim 18, wherein the second element encloses the first actuation element in the manner of a ring and/or collar.

22. The pump as set forth in claim 18, wherein the second actuation element has at least one bearing element with a bearing eye engaging with a mounting pin of a retaining arm of the outer casing.

23. The pump as set forth in claim 22, wherein the mounting pin is chamfered on its free end so that the second actuation element can be snapped on the outer casing.

24. The pump as set forth in claim 22, wherein the second actuation element has two mutually spaced apart bearing elements with a bearing eye each, wherein the retaining arm has oppositely arranged bearing pins associated to each bearing eye.

25. The pump as set forth in claim 18, wherein first actuation area is provided with a structure, wherein the structure is one of a ribbing, a coating or a mark as to be intuitively or palpably identifiable for a user.

* * * * *